United States Patent [19]

Sundberg

[11] Patent Number: 4,575,139

[45] Date of Patent: Mar. 11, 1986

[54] RETAINING DEVICE

[76] Inventor: Alf H. Sundberg, Flintåsvägen 8, S-191 54 Sollentuna, Sweden

[21] Appl. No.: 608,199

[22] Filed: May 8, 1984

[30] Foreign Application Priority Data

May 10, 1983 [SE] Sweden ..... 8302678

[51] Int. Cl.[4] ..... E05C 17/16

[52] U.S. Cl. ..... 292/265

[58] Field of Search ..... 292/265-278

[56] References Cited

U.S. PATENT DOCUMENTS 390,274 10/1888 Wicks ..... 292/265

3,807,780 4/1974 Asp et al. ..... 292/265

*Primary Examiner*—Richard E. Moore

*Attorney, Agent, or Firm*—Birch, Stewart, Kolasch & Birch

[57] ABSTRACT

The present invention relates to a device for retaining casement windows, doors or the like, comprising firstly a bar and secondly a catch member. For locking and to resist separation of the legs of the catch member, which carry catch heels cooperating with the catch bar, which would free the catch member from the bar, when there is a compressive force between the outer end stop of the bar and the catch member, the catch member is provided adjacent to its recess receiving the bar and the outer stop on the bar is provided with means engageable with each other.

10 Claims, 4 Drawing Figures

RETAINING DEVICE

BACKGROUND OF THE INVENTION

1. Field of the Invention

The present invention relates to a device for retaining casement windows, doors or the like, comprising firstly a bar adapted to be pivotally mounted on either a stationary portion or a movable portion of the window, door or the like, and secondly a catch member adapted to be mounted on the other one of the stationary or movable portions of the window, door or the like, and arranged to cooperate with the bar to releasably fix the stationary and the movable portions in a desired relative position, said bar having, at least on one side but preferably on two opposite sides, a longitudinal guide groove with a number of adjoining, transverse catch notches adapted to receive a catch heel arranged on at least one, but preferably on two opposite, facing walls defining a recess in the catch member for receiving the bar, said bar having at its outer end a stop which limits the movement of the catch member outwards along the guide groove in the bar.

2. Description of Background Art

A retaining device of this type is previously known by U.S. Pat. No. 3,807,780. When such a retaining device is used, for example, on an inwardly opening casement window, the catch member is mounted on the window sash, while the bar is fastened to the stationary window casing. From a closed position it is possible to open the window to a number of different limited opening angles by sliding the opposing heels in the catch member in their respective longitudinal grooves in the bar, and to lock it by swinging the arm so that the heels of the catch member snap into the desired catch notch on the bar. The bar and the catch member are adapted so that the bar can be completely released from the catch member in order to permit the window to be swung out to an entirely open position, for washing the window, for example. For this purpose, there is a notch between the respective guide groove and one lateral edge of the bar, with a little threshold being preferably arranged in this notch to prevent unintentional release of the bar from the catch member. Thus, in order to release the bar, it must be pressed with additional force away from the recess in the catch member receiving the bar, whereby the heels are forced apart by the threshold. The bar also has a slide-on ramp near the inner end of the guide groove, so that the catch member can be automatically coupled to the bar, when the window is being closed, by forcing the heels to separate and slide up on the ramp and snap into the guide groove in the bar.

This flexibility in at least one of the heeled legs of the catch member can, however, under certain conditions, cause an undesired release of the bar from the catch member; specifically if the latter is caused to be pressed quite hard against the outer end stop on the bar, e.g. if the window is opened violently. In this case the legs with the heels may be pressed apart so far by the bar end-stop that it can pass in its entirety through the recess in the catch member, thus freeing the bar from the catch member.

SUMMARY AND OBJECTS OF THE INVENTION

The purpose of the present invention is to remove this disadvantage in the known retaining device and to suggest a solution by means of which such separation of the heels can be prevented when there is a substantial compressive force between the outer bar stop and the catch member. For this purpose, the retaining device described by way of introduction is characterized according to the invention in that the catch member, on at least one but preferably on both opposing side walls and adjacent to the recess receiving the bar, and the outer stop on the bar have means engageable in each other, when the catch member is in its outer end position on the bar, for locking resisting separation of the defining walls of the recess in the catch member, when a compressive force is applied between the outer stop of the bar and the catch member.

Suitably the means engageable in each other have the form of a grooved coring out in the catch member, which runs parallel to and preferably on both sides of the lateral defining walls of the recess, while the outer stop of the bar has at least one corresponding projection adapted to engage in the grooved coring out.

BRIEF DESCRIPTION OF THE DRAWINGS

A suitable embodiment of the invention is described in more detail below with reference to the accompanying drawing, in which.

DETAILED DESCRIPTION OF THE INVENTION

Figure 1:
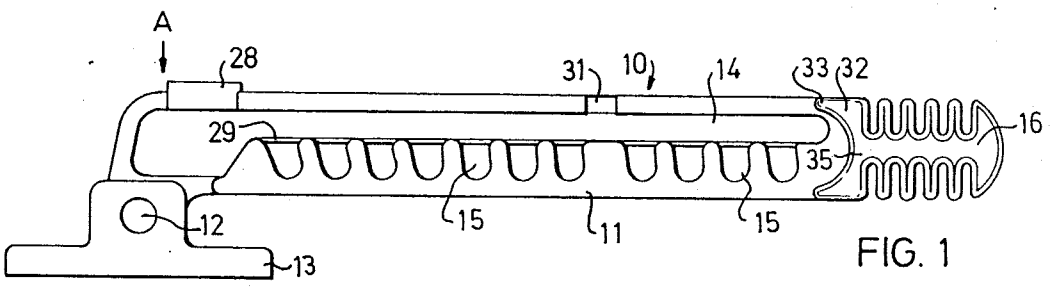
FIG. 1 is a plan view of a pivotable catch bar of the retaining device according to the invention.
Figure 2:
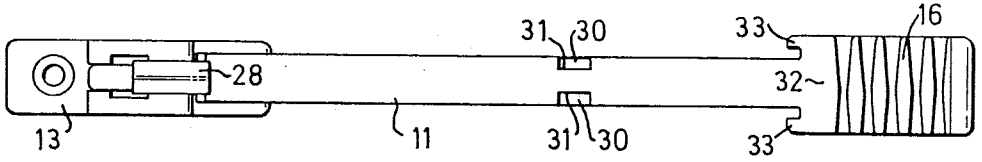
FIG. 2 is a side view of the bar in FIG. 1.

The catch bar 10, shown in FIGS. 1 and 2, of the retaining device according to the invention consists of an elongated bar member 11, which by means of a joint 12 is pivotally connected at one end to a bracket 13, which is adapted to be screwed fast in a known manner to the window casing in an inwardly opening window or to the sash of an outwardly opening window. As does the catch bar in Swedish Patent Specification No. 355 043, the bar member 11 has on both sides a longitudinal guide groove 14 and a plurality of adjoining, transverse catch notches 15. The outer end of the bar 11 is provided with a finger grip 16 for operating the catch bar.

Figure 3:
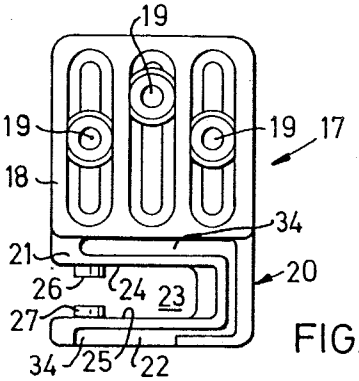
FIG. 3 is a side view of the catch member according to the invention.

FIG. 3 shows a catch member 17 adapted to cooperate with the bar 11. The embodiment of the catch member 17 shown is designed to be mounted on the sash of an inwardly opening window and consists of a mounting portion 18 with holes 19 for mounting screws and a bar 11 receiving portion in the form of a U 20 with two opposing legs 21 and 22 defining a transverse recess 23 between the same. Pin-shaped heels 26 and 27 are arranged facing each other on the two walls 24 and 25 of the recess 23.

After mounting the two components of the device on the respective parts of the window, the bar 11 and the catch member 17 are engaged upon closing the window by the heels being forced apart when they slide up (in the direction of arrow A in FIG. 1) on a slide-in ramp 28 to the guide groove 14 at the inner end of the bar. This is possible because the lower leg 22 is forced resiliently downwards during the sliding-on. After engagement, the catch member 17 fixed to the window sash can be displaced with its heels sliding in the guide grooves 14 on either side of the bar 11 to a position directly in front of a pair of catch notches 15 providing a suitable opening angle for the window. The bar 11 is then swung so that the heels 26 and 27 snap over ridges 29 at the entrance to the respective pair of catch notches 15.

The bar 11 also has, as is known, two recesses or notches 30 on one longitudinal edge, which open into the respective guide grooves 14, and which makes it possible to release the bar 11 from the catch member 17, for washing the window for example. In order to make it more difficult for children to release the bar from the catch member, the notches 30 are only so deep that thresholds 31 remain between the guide grooves 14 and the notches 30, which means, in other words, that the distance between the two opposite bottoms of the notches 30, i.e. between the threshold surfaces 31, is somewhat greater than the free gap between the two heels 26 and 27. Therefore, force will be required to separate the legs 21 and 22 when the heels 26 and 27 are directly in front of the notches 30 in order to swing the bar 11 free from the catch member 17.

In order to limit the movement of the catch member 17 out on the bar 11 along the guide groove 14, an end stop 32 is formed adjacent to the outer end of the respective guide groove 14. This stop is adapted to cooperate with the sides of the legs 21 and 22 on the catch member 17. In accordance with the present invention, these cooperating parts of the end stop 32 and the sides of the legs 21 and 22 are provided with parts engageable in each other to lock the catch member 17 and the bar 11 in one transverse direction and prevent separation of the legs 21 and 22 and thus release of the catch member from the bar, even if there is a substantial compressive force between the stop 32 and the legs 21 and 22. Preferably, these engaging parts comprise at least one projection on the stop 32, directed towards the inner end of the bar 11, and a grooved coring out 34 around the recess 23.

Figure 4:
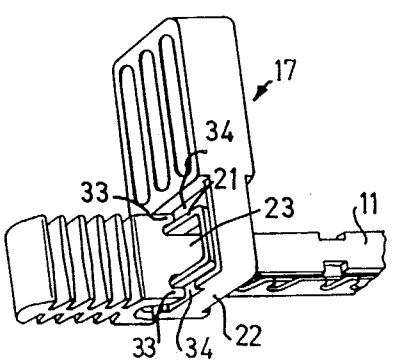
FIG. 4 shows in perspective the engagement between the catch member and the outer stop of the bar, to prevent separation of the legs of the catch member defining the recess.

FIG. 4 shows in detail how the projections 33 engage in the coring out 34 and achieve the desired locking. Preferably, the stop 32 has an arcuate concavity 35 (FIG. 1) adjacent to the projection 33 to receive the outer ends of the legs 21 and 22 in various relative angular positions between the bar and the catch member.

Although the parts engaging each other in the embodiment shown are shown as projections on the end stop 32 and cavities in the legs 21 and 22, it is of course possible within the scope of the present invention to reverse the placement of these engaging parts.

I claim:

1. A device for retaining casement windows, doors or the like, comprising:

a bar pivotally mounted on a stationary portion of the window, door or the like;

a catch member mounted on the movable portion of the window, door or the like, and arranged to cooperate with the bar to releasably fix the stationary and the movable portions in a desired relative position;

said bar having a longitudinal guide groove on at least one side with a number of adjoining, transverse catch notches;

a catch heel arranged on at least one facing wall defining a recess in the catch member for receiving the catch notches of the bar;

said bar having at its outer end a stop which limits the movement of the catch member outwards along the guide groove in the bar;

the catch member, on at least one side wall adjacent to the recess receiving the bar, and the outer stop on the bar, including means engageable in each other, when the catch member is in its outer end position on the bar, for locking and resisting separation of the defining walls of the recess in the catch member, when a compressive force is applied between the outer stop of the bar and the catch member.

2. Retaining device according to claim 1, characterized in that the means engageable in each other have the form of a grooved coring out in the catch member which runs parallel to the defining walls of the recess, while the outer stop of the bar has at least one corresponding projection adapted to engage in the grooved coring out.

3. A retaining device according to claim 1, wherein said bar includes a longitudinal groove on both opposite sides.

4. A retaining device according to claim 1, wherein said catch heel is arranged on two opposite facing walls defining a recess in the catch member for receiving the catch notches of the bar.

5. A retaining device according to claim 1, wherein the catch member, on both opposing side walls adjacent to the recess receiving the bar and the outer stop on the bar, includes means engageable in each other, when the catch member is in its outer end position on the bar, for locking and resisting separation of the defining walls of the recess in the catch member, when a compressive force is applied between the outer stop of the bar and the catch member.

6. A device for retaining casement windows, doors or the like, comprising:

a bar pivotally mounted on a movable portion of the window, door or the like;

a catch member mounted on the stationary portion of the window, door or the ike, and arranged to cooperate with the bar to releasably fix the stationary and the movable portions in a desired relative position;

said bar having a longitudinal guide groove on at least one side with a number of adjoining, transverse catch notches;

a catch heel arranged on at least one facing wall defining a recess in the catch member for receiving the catch notches of the bar;

said bar having at its outer end a stop which limits the movement of the catch member outwards along the guide groove in the bar;

the catch member, on at least one side wall adjacent to the recess receiving the bar, and the outer stop on the bar, including means engageable in each other, when the catch member is in its outer end position on the bar, for locking and resisting separation of the defining walls of the recess in the catch member, when a compressive force is applied between the outer stop of the bar and the catch member.

7. Retaining device according to claim 6, characterized in that the means engageable in each other have the form of a grooved coring out in the catch member which runs parallel to the defining walls of the recess, while the outer stop of the bar has at least one corresponding projection adapted to engage in the grooved coring out.

8. A retaining device according to claim 6, wherein said bar includes a longitudinal groove on both opposite sides.

9. A retaining device according to claim 6, wherein said catch heel is arranged on two opposite facing walls defining a recess in the catch member for receiving the catch notches of the bar.

10. A retaining device according to claim 6, wherein the catch member, on both opposing side walls adjacent to the recess receiving the bar and the outer stop on the bar, includes means engageable in each other, when the catch member is in its outer end position on the bar, for locking and resisting separation of the defining walls of the recess in the catch member, when a compressive force is applied between the outer stop of the bar and the catch member.

* * * * *